United States Patent [19]

Lusch

[11] Patent Number: 4,469,232

[45] Date of Patent: Sep. 4, 1984

[54] DISPLAY STAND

[75] Inventor: Peter Lusch, Bielefeld, Fed. Rep. of Germany

[73] Assignee: Ferdinand Lusch GmbH & Co. KG., Bielefeld, Fed. Rep. of Germany

[21] Appl. No.: 289,520

[22] Filed: Aug. 3, 1981

[30] Foreign Application Priority Data

Mar. 6, 1981 [DE] Fed. Rep. of Germany ... 8106318[U]

[51] Int. Cl.[3] ..... A47F 5/00

[52] U.S. Cl. ..... 211/189; 211/186; 108/111

[58] Field of Search ..... 211/189, 186, 207, 208, 211/190; 108/106, 107, 111

[56] References Cited

U.S. PATENT DOCUMENTS

| | | | |
|---|---|---|---|
| 2,894,642 | 7/1959 | Clevett et al. | 108/106 |
| 2,908,395 | 10/1959 | Patterson | 108/106 X |
| 2,991,889 | 7/1961 | Levy et al. | 211/190 |
| 3,160,281 | 12/1964 | Ruhnke | 211/189 |
| 3,221,678 | 12/1965 | Doherty | 108/106 |
| 4,000,841 | 1/1977 | Bachi | 211/190 X |

*Primary Examiner*—Ramon S. Britts
*Assistant Examiner*—Robert W. Gibson, Jr.
*Attorney, Agent, or Firm*—Michael J. Striker

[57] ABSTRACT

A display stand for use in department stores and the like, is assembled of at least one base structure holding an upright supporting frame, the base structure being assembled of a set of selectively interconnectable standard structural sections, the set comprising a compound end section including three side walls and an end cover portion; a bridge-like intermediate section including two opposite walls and another cover portion; and a plate-shaped closure end section. The outer corners of the composed end section are preferably bevelled, and the sections are interconnectable by means of fish plates which may be rigidly connected to U-shaped pieces for holding the upright frame structure.

16 Claims, 10 Drawing Figures

Fig. 10
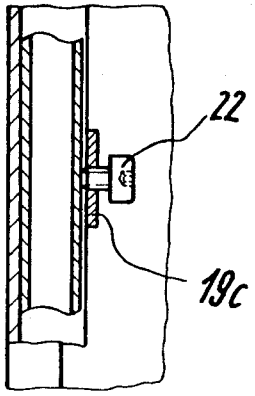
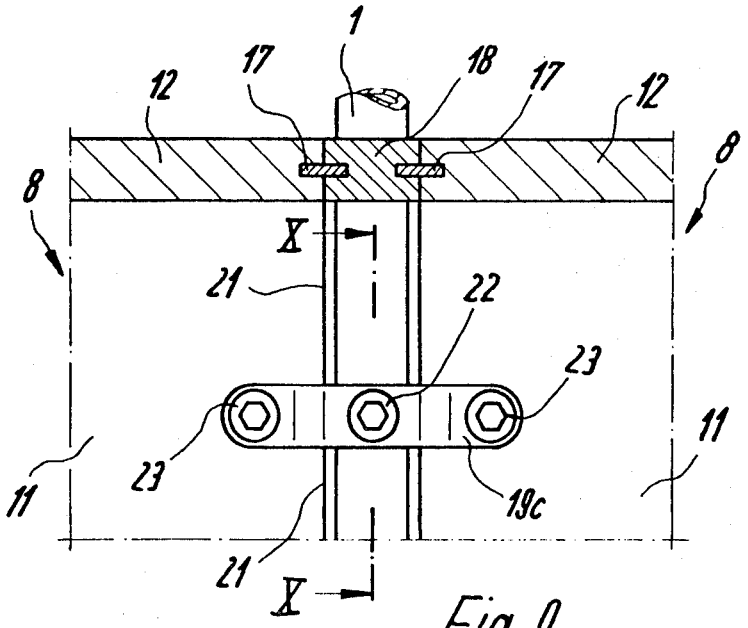
Fig. 9

DISPLAY STAND

BACKGROUND OF THE INVENTION

The present invention relates in general to a display stand as used in stores, and in particular to a display stand of the type having an upright supporting frame and at least one base structure.

Display stands of this type are generally known equipment in retail stores. They serve for displaying goods and articles to be sold. In order to create in a store or in a department of a storehouse an open atmosphere assisting and promoting the sales, there are necessary display stands of various designs whereby care is taken that differently structured stands result in a harmoniously adjusted overall arrangement, that is, in spite of differing designs of individual display stands an underlying common concept in designing the layout should be recognizable.

Display or exhibit stands of this kind are known from prior art which have only one base, but known are also constructions having two or more floors. In display stands provided with a single base floor only, the latter is made either as a socket constituting the lower termination of the stand, or it is also possible that the single floor or base plate is mounted on a supporting frame at the level of a table. In the case of display stands having two or more floors, the base floor is again formed in the form of a socket or pedestal for the whole stand and an intermediate floor or base is arranged at the level of a table whereas an uppermost floor terminates the stand in a fashion of a canopy.

In such constructions, the surface areas of respective base plates in a display stand can be of different size. Also in a production program for the display stands it may be also desirable to design stands having different floor spaces.

SUMMARY OF THE INVENTION

It is therefore a general object of the present invention to provide an improved display stand of the aforedescribed type, in which by means of a limited amount of preformed component sections it becomes possible to create a large number of base plates or floors of different configuration.

In keeping with these objects and others which will become apparent hereafter, one feature of the invention resides, in a display stand of the aforementioned type, in the provision of a base structure which is assembled of a set of collectively interconnectable structural elements whereby each set comprises one end section including three side walls and an end cover portion, a bridge-like intermediate section including two opposite walls and another cover portion, and another end section in the form of a plate.

The three standard sections enable a multitude of combinations in assembling a base or floor of a display stand, resulting in a large number of different constructions and various design appearances. For instance, it is possible to assemble a base composed of juxtaposed first mentioned end sections, or of the two first end sections with one or more intermediate sections therebetween, or the first end section adjoining an intermediate section which is terminated with the plate-shaped second end section.

The first end sections, the intermediate sections as well as the plate-shaped closure end sections are made preferably of wood or each as a one-piece plastic member.

The base unit assembled according to this invention of a plurality of sections always results as to its shape into a box open at one side thereof. If the base or floor assembled according to this invention is mounted in the frame of the display stand at the eye level, the open side of the base structure is directed downwardly. If the base structure is situated above the eye level, the open side of the base box is directed upwardly.

Particularly when wood is used for constructing the individual sections of the base, it is of advantage when the completed base structure in the range of its visible surfaces is covered with a lining, for example with a stretched fabric, or it is also possible to coat the base by gluing thereon a wall paper or the like.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 9 is a side view of a cut away part of the base structure illustrating means for joining two sections; and FIG. 10 is a sectional side view taken along the line X—X in FIG. 9.

DESCRIPTION OF THE PREFERRED EMBODIMENTS

Figure 1:
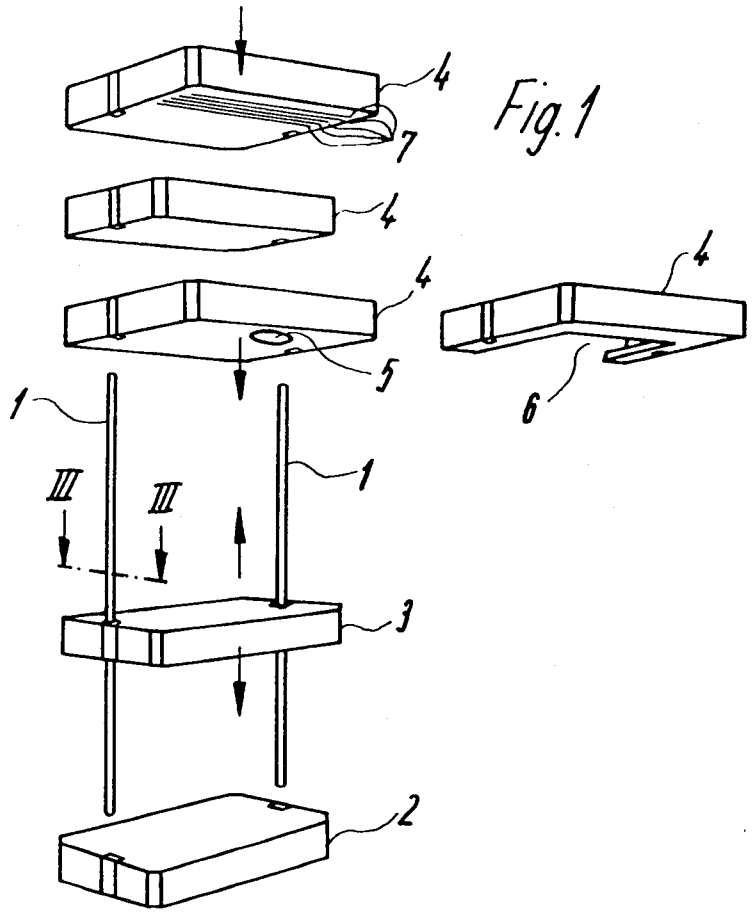
FIG. 1 is a perspective exploded view of a display stand with a plurality of superposed floors or base structures assembled in accordance with this invention into different configurations.

In FIG. 1 there is illustrated a display stand formed of a supporting frame constituted by two upright tubes 1 and of three base structures 2–4 connectable to the supporting tubes 1.

In the embodiment according to FIG. 1, the lowermost base structure 2 acts as a socket or pedestal for the whole stand.

Base structure 3 forms an intermediate floor of the display stand, whereas the uppermost base structure 4 terminates the stand construction and has its open side directed upwardly. The top base structure 4 can be formed with a cover plate having a cut-out 5 or a recess 6 or slots 7 as illustrated in FIG. 1. The cut-outs 5, the recess 6 or the slots 7 make it possible to install in the stand spherical fixtures, illumination fixtures, or speaker units.

The embodiment of the display stand as indicated in FIG. 1 represents by way of an example one of many possible design variations. For instance, it is possible to dispense with the intermediate floor 3 and provide instead in the intermediate frame region an array of shelves or other deposit or suspension devices. It is also possible to make the supporting frame, instead of upright tubes, in the form of a one-piece tubular frame with connected upper ends whereby the top base structure 4 can be omitted. Also it is possible to employ base structures of different surface areas mounted in a single frame.

Figure 2:
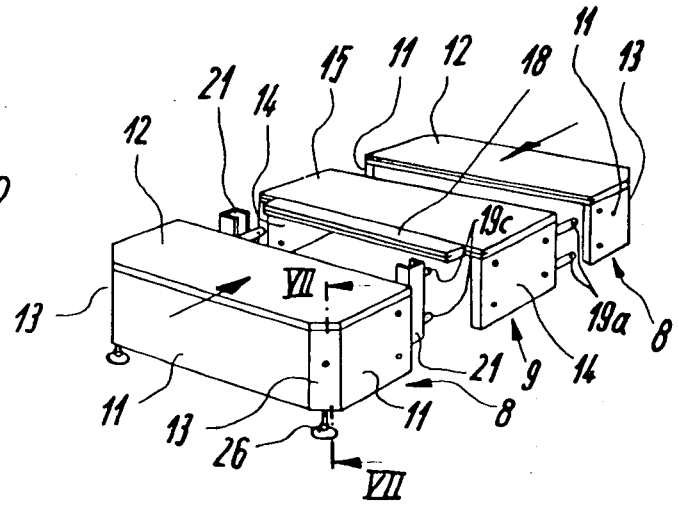
FIG. 2 is a perspective exploded view of a base structure according to this invention before its final assembly.
Figure 5:
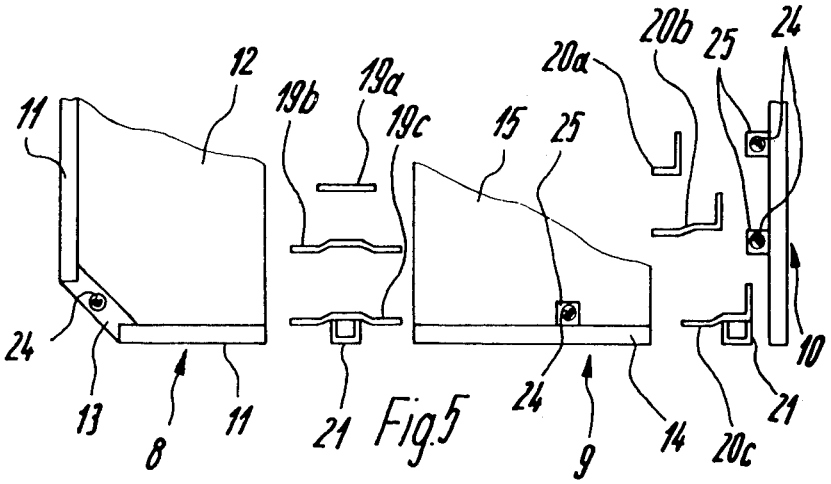
FIG. 5 is a bottom view of a cut away part of another variation of the base structure of this invention illustrated with different types of applicable fastening elements.
Figure 6:
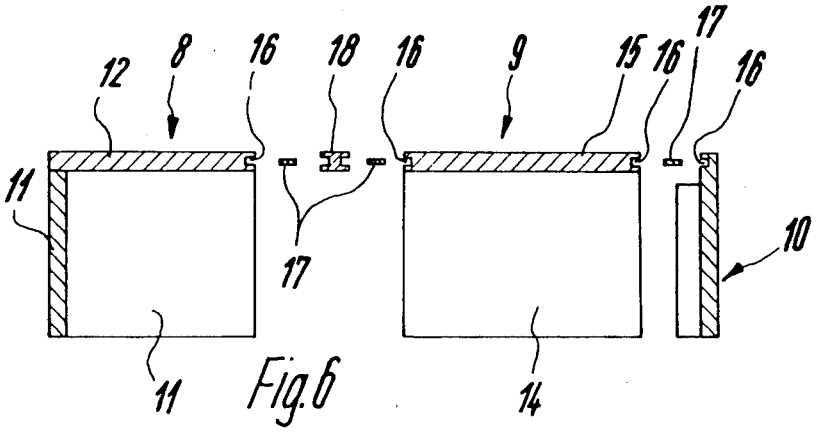
FIG. 6 is a sectional side view of the structure of FIG. 5 before its final assembly.
Figure 7:
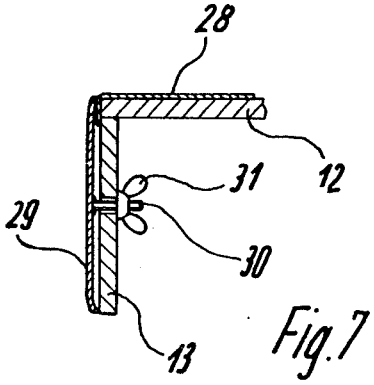
FIG. 7 is a sectional side view of a cut away part of a base section taken along the line VII—VII in FIG. 2 and equipped with a corner cover.

Referring now to FIGS. 2, 5 and 6, each of the base structures 2–4 is assembled of three separate sections, namely of a compound prismatic end section 8, an intermediate section 9 having a bridge-like shape, and a closure section 10.

The prismatic end section 8 is formed essentially of three side plates 11 and a cover plate 12 and has a substantially rectangular cross section. The corners of side plates 11 are chamfered and interconnected by connecting pieces 13 forming with the plane of the side plates 11 an angle of 45°. The purpose of this chamfering will be explained below.

The intermediate base section 9 is made essentially of two side plates 14 connected by another cover plate 15 into a bridge-like structure. The closure piece 10 has a plate-like configuration and in the simplest case is constituted by a single plank.

As seen in FIG. 6, the adjoining surfaces of respective base sections 8, 9 and 10 are formed with longitudinal grooves 16, and the narrow free faces of cover plates 12 and 15 are provided with corresponding cut-outs.

The longitudinal grooves 16 serve for joining the base sections together by means of coupling springs 17 or if desired by means of a double-grooved spacer strip 18.

The compound prismatic end section 8 is connectable with the adjoining intermediate section 9 by means of three different sorts of fish plates or butt straps **19*a*, 19*b* and 19*c*. Two different angular pieces 20*a*, 20*b* and 20*c* serve for fastening an end section 8 or an intermediate section 9 to the closure section 10. Fish plates designated by reference numeral 19*a* and angular pieces 20*a* are employed in the case when the sections to be connected adjoin each other with their contact surfaces, that is, when the spacer strip 18** is dispensed with.

If on the other hand the spacer strip 18 is used for joining together two base sections, fish plates **19*b* or 19*c* or angles 20*b* or 20*c* are applicable. As apparent from FIGS. 2 and 5, fish plates 19*c* are rigidly connected in pairs to a U-shaped piece 21. The width of the U-shaped piece 21 corresponds to the width of the spacer strip 18. The supporting tubes 1 are inserted into respective U-shaped profiles 21 and fastened by clamping screws 22 (FIGS. 9 and 10**).

Fish plates **19*c* are fastened by screws 23 screwed into non-illustrated nuts driven or locked in the side walls 11 and 14**.

The stamped-in nuts are also provided in the spacer strips 18 and fish plates **19*c* or 19*b* are formed with corresponding intermediate holes for passing through the screws 23. If the spacer strips 18 are not used in assembling the base structure, then smaller fish plates 19*a* are employed having through holes for screws 23** spaced apart about a distance corresponding to the spacing of the nuts.

As seen from FIG. 2, spacer strips 18 are shorter than the length of the cover portions 12 and 15 about a distance corresponding to the combined width of two U-shaped pieces 21, which in the assembled base structure abut against the end faces of the strips 18 and are also clamped laterally between the end faces of the side plates 11 and 14. Consequently, a supporting tube inserted into each of the U-shaped pieces 21 is within the limits of the perimeter of the cover of the base plate formed by cover portions 12 and 15. If fish plates **19*b* are used for connecting the base sections without the use of U-shaped pieces 21, a free space corresponding to the cross section of the pieces 21 will result between the opposite faces of side plates 11 and 24** and these free spaces can be used for accommodating a closed frame.

The aforementioned corner angles **20*a*, 20*b* and 20*c* are made in similar fashion as the corresponding fish plates 19*a*–19*c*. It is therefore possible when using a small corner angle 20*a* to connect the closure piece 10 directly against the sections 8 or 9, whereas the corner angles 20*b* and 20*c* enable the connection of the sections 8 and 9 by means of the interposed spacer strip 18. The corner angles 20*c* are again rigidly connected to a U-shaped piece 21 when it is desired to locate a pair of supporting tubes in corner areas of the base. The compound end sections 8 in the range of the slanted corner pieces 13 are also provided with stamped-in nuts 24, whereas the intermediate sections 9 have on the inner surface of their side walls 14 a block 25 with a stamped-in nut 24; the terminal or closure section 10 is also provided with two blocks 25 with stamped-in nuts 24. These nuts 24 serve for receiving adjustable supporting legs 26, if desired (FIG. 2**).

Figure 3:
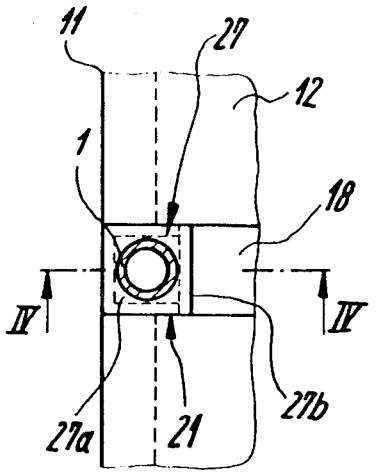
FIG. 3 is a plan view of a cut away part of FIG. 1 taken along the line III—III.
Figure 4:
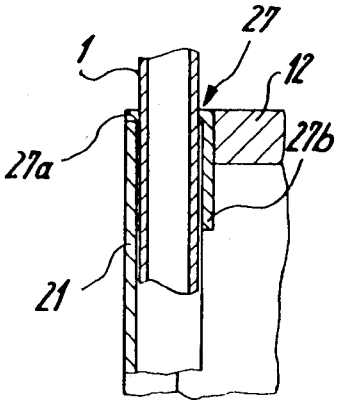
FIG. 4 is a sectional side view of a cut away part of this invention taken along the line IV—IV in FIG. 3.

If the supporting frame of the stand is constituted by tubular pieces 1 of a round cross section, it is of advantage when the U-shaped pieces 21 are closed by a cover angle 27 having a round flange **27*a*, the inner diameter of which corresponds to the diameter of the round supporting tubes 1. The downwardly bent arm 27*b* of the cover angle 27 covers the open side of the U-shaped piece 21 as seen from FIGS. 3 and 4. In the event that the base structure is used at the top of the supporting tubes 1, the cover angles 27 are arranged on the U-shaped pieces 21 in a reversed position, that is the solid arm 27 is placed on top of the U-shaped piece 21 to rest on the ends of the tubular support 1, and the circular flange 27** is directed downwardly.

Upon completing the assembly of base structures 2–4 from two or more sections 8–10, it is advantageous to cover the structures with a lining 28 of a fabric or another suitable material. The lining 28 can be first secured to the inner surface of side plates 11 and 14 and of the terminal closure piece 10; the unavoidable intersecting edges in the corner area are fastened by the aforementioned corner pieces 13 and covered by an ornamental cap 29 to the inner surface of which a projecting screw 30 is secured by welding or soldering. The screw 30 passes through the corresponding corner piece 13, whereupon the cap 29 is held in position by a wing nut 31.

Figure 8:
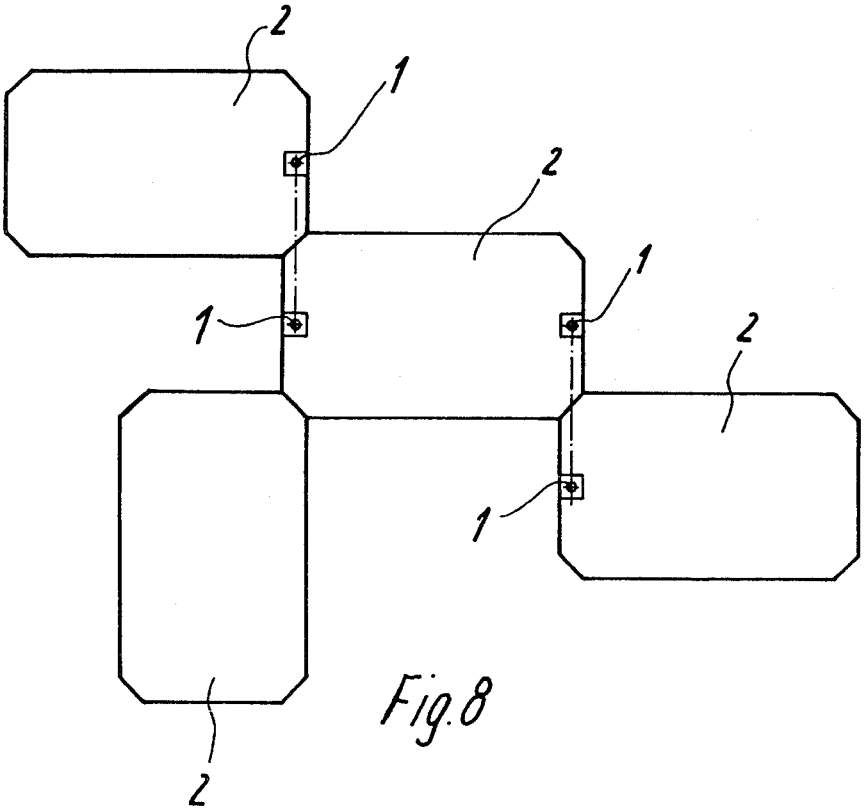
FIG. 8 is a schematic top view of another variation of a base structure of this invention assembled of the standard sections.

Another possible arrangement of base structures according to this invention is illustrated in FIG. 8. The slanted corners of several base structures 2 are joined in such a manner as to form a staggered combined base, whereby the pairs of supporting tubes 1 of each stand frame are inserted in an adjoining pair of base structures 2 in such a manner that the plane delimited by the supporting tubes 1 extends parallel to the shorter edges of the base structures.

As is apparent from the above example, by using only three standard sorts of base sections 8–10 it is possible to create a large variety of display stands using different base or floor structures 2–4 or different combinations of such base structures. Furthermore, by selecting a particular mode of connection of the base sections from a limited number of different fastening elements such as fish plates or corner angles, it is still possible to increase the versatility of the display stand of this invention without the necessity of using an excessive number of different fastening elements.

Moreover, by manufacturing the base sections 8–10 in three different standard sizes it is ensured that both the manufacturing cost and the storing cost is substantially reduced when considered in comparison to the extremely large number of combinational possibilities.

It will be understood that each of the elements described above, or two or more together, may also find a useful application in other types of constructions differing from the types described above.

While the invention has been illustrated and described as embodied in a display stand for stores or warehouses, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A display stand comprising an upright frame and at least one base structure, said base structure being assembled of at least two prismatic end sections each including three side plates and an end cover plate connected to said three side plates and defining a narrow free face, and a bridge-like intermediate section including two opposite side plates and another cover plate and defining two opposite narrow free faces connectable to the narrow free faces of said prismatic and sections; coupling means for rigidly connecting said sections arranged in face-to-face relationship; and at least one upright U-shaped piece provided in said base structure connecting two of said sections snd supporting said frame.

2. A display stand comprising an upright frame and at least one base structure, said base structure being assembled of at least three standard structural sections comprising (a) a prismatic end section including three side plates and an end cover plate connected to said three side plates and defining a narrow free face;

(b) a bridge-like intermediate section including two opposite side plates and another cover plate connected to said three side side plates and defining two opposite narrow free faces; one of which being connectable to the narrow free face of said prismatic end section;

(c) a plate-shaped closure end section defining two opposite broad faces one of which being connected to the other narrow free face of said intermediate section;

coupling means for rigidly connecting said structural sections arranged in face-to-face relationship; and at least one U-shaped piece provided in said base structure connecting two of said sections for supporting said frame.

3. A display stand as defined in claim 2, wherein the adjoining faces of said cover plates and of said closure end section are formed with coupling grooves for receiving said coupling means.

4. A display stand as defined in claim 3, wherein said coupling means are coupling springs.

5. A display stand as defined in claim 3, further including double-grooved spacer strips of a shorter length than the free faces of said cover portions, said spacer strips being insertable between said cover plates and/or a cover plate and said closure end section and connectable thereto by said coupling means.

6. A display stand according to claim 5, further including nuts stamped in the side walls of said prismatic end section and in the walls of said intermediate section, and a set of fish plates formed with holes to connect said sections by means of fastening screws.

7. A display stand as defined in claim 6, wherein at least one pair of said fish plates is rigidly connected to U-shaped pieces the width of which corresponds to said spacer strips.

8. A display stand as defined in claim 7, wherein at least one pair of said fish plates is provided with holes located for connecting two base structures without the use of said spacer strips and said U-shaped pieces.

9. A display stand as defined in claim 6, further including a set of corner angles for connecting said closure end section to one of the prismatic end section or to the intermediate section.

10. A display stand as defined in claim 9, wherein at least one of said corner angles is rigidly connected to said U-shaped piece for receiving said supporting frame.

11. A display stand as defined in claim 2, wherein the outer corners of the end cover plate of the prismatic base sections are bevelled about 45° relative to the free face thereof and said side plates being interconnected by correspondingly slanted corner pieces.

12. A display stand as defined in claim 11, wherein said corner pieces of the prismatic end sections as well as the inner surfaces of said intermediate end section and of said closure end section are provided with blocks with stamped-in nuts for receiving adjustable supporting legs.

13. A display stand as defined in claim 12, further including ornamental caps corresponding in size to said corner pieces and being attachable thereto by means of projecting screws and wing nuts for clamping an outer lining of a fabric or the like material.

14. A display stand as defined in claim 7, wherein said U-shaped piece is provided with a clamping screw, whereby said supporting frame is insertable into said U-shaped piece and held in position by said clamping screw.

15. A display stand as defined in claim 7, further including an angular piece matching the inner cross section of said U-shaped piece and being provided with a circular flange for receiving a round frame.

16. A display stand as defined in claim 2, wherein at least one of said cover plates is provided with a cut-out, or a recess or with grooves for receiving auxiliary fixtures.

* * * * *